United States Patent [19]

Schnabel et al.

[11] 4,241,743

[45] Dec. 30, 1980

[54] ADJUSTABLE WIPER CONTAINER AND APPLICATOR ASSEMBLY FOR COSMETICS AND THE LIKE

[75] Inventors: Peter W. Schnabel, Shrewsbury, Pa.; Milton P. Chernack, West Hempstead, N.Y.; Lawrence T. Wilkes, York, Pa.; Gordon R. Perry, Brooklyn, N.Y.

[73] Assignee: Noxell Corporation, Baltimore, Md.

[21] Appl. No.: 20,247

[22] Filed: Mar. 13, 1979

[51] Int. Cl.[3] ..... A45D 40/26

[52] U.S. Cl. ..... 132/88.7; 401/122

[58] Field of Search ..... 132/88.5, 88.7; 401/122, 128

[56] References Cited

U.S. PATENT DOCUMENTS

| | | | |
|---|---|---|---|
| 3,372,424 | 3/1968 | Kellet | 401/122 X |
| 3,469,928 | 9/1969 | Undegren | 401/122 |
| 3,662,769 | 5/1972 | Vasas et al. | 132/88.7 |
| 3,817,637 | 6/1974 | Vasas | 401/122 |
| 3,861,810 | 1/1975 | Vasas | 401/122 |
| 3,883,254 | 5/1975 | Vasas | 401/122 |
| 3,891,330 | 6/1975 | Vasas | 401/122 |
| 3,892,248 | 7/1975 | Kingsford | 132/88.7 |
| 3,896,823 | 7/1975 | Spatz | 132/88.7 |
| 3,921,650 | 11/1975 | Montgomery | 132/88.7 |

*Primary Examiner*—Theodore A. Granger

*Attorney, Agent, or Firm*—Mason, Fenwick & Lawrence

[57] ABSTRACT

An adjustable wiper container and applicator assembly for applying cosmetics such as mascara and the like to eyelashes including an applicator having an elongated stem terminating in an elongated brush-like applicator head formation and a container for the cosmetic material in which the brush-like applicator head formation and adjacent stem portion is to be stored. The container has an opening through which the stem of the applicator is to extend, and an elastic deformable wiper mounted on the container at the opening having movable wiper edge portions providing a variable size wiper orifice through which the applicator head formation is withdrawn for use in applying cosmetic material to the eyelashes or the like. A manually adjustable orifice regulating member movable on the container adjacent the opening is provided for moving the wiper edge portions to vary the positions of the edge portions relative to each other and provide different wiper orifice sizes to control the amount of cosmetic material remaining on the head formation when it is withdrawn from the container.

21 Claims, 11 Drawing Figures

FIG-5
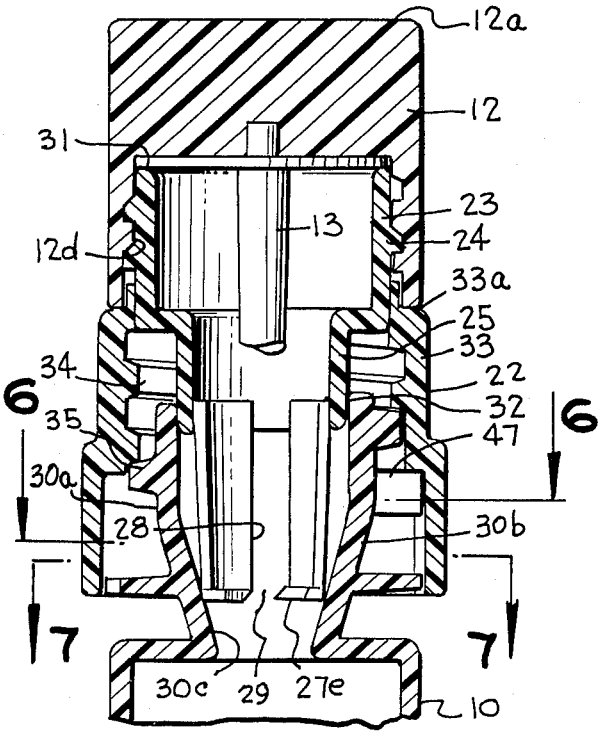
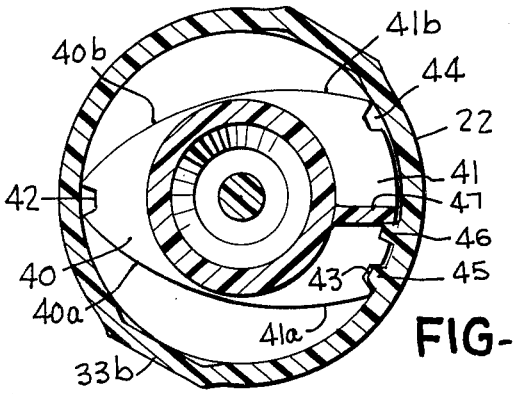
FIG-6
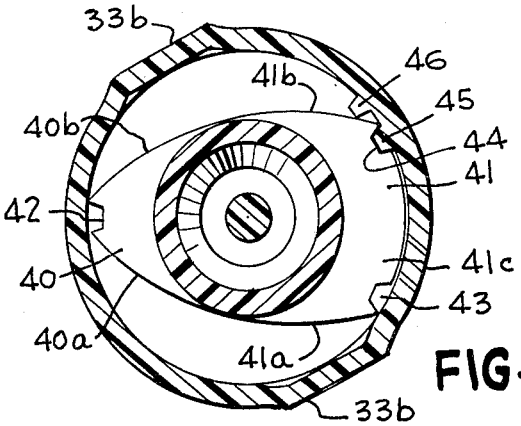
FIG-7
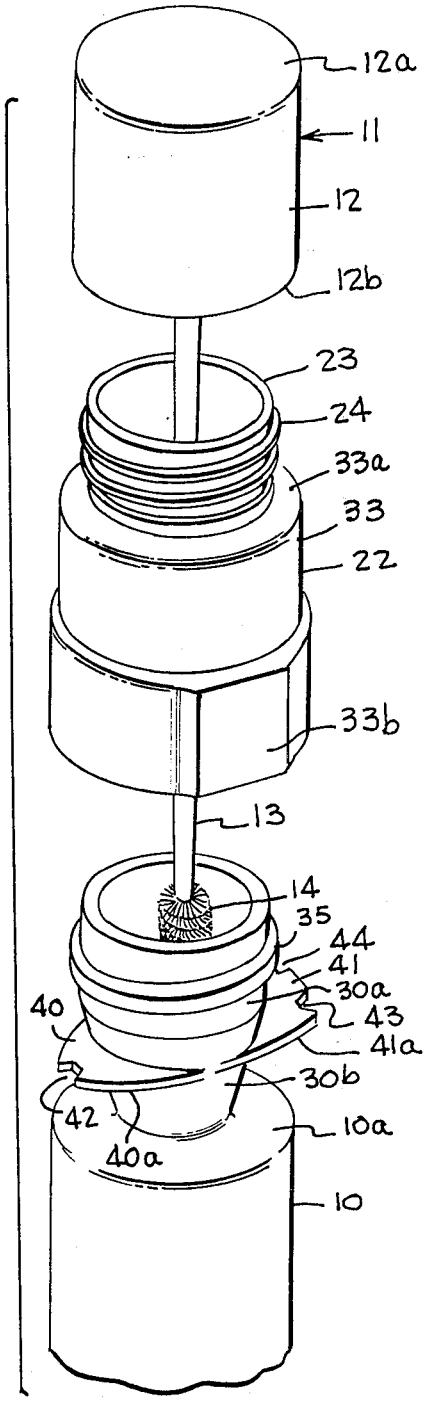
FIG-8

ADJUSTABLE WIPER CONTAINER AND APPLICATOR ASSEMBLY FOR COSMETICS AND THE LIKE

BACKGROUND AND OBJECTS OF THE INVENTION

The present invention relates in general to cosmetic applicator and container assemblies, and more particularly to a container and applicator assembly for applying coloring or other material, such as mascara, to eyelashes wherein adjustable means are provided for varying the quantity of mascara or other cosmetic retained by the applicator when it is withdrawn from the container.

For a number of years, eye makeup has attained increasing popularity and more attention on the part of the cosmetic industry and particularly suppliers of cosmetics has been devoted to design and improvement of devices for applying mascara or similar materials to the eyelashes. Mascara packages in recent years have included an applicator member to be disposed in a container having a mass of mascara therein, with the applicator member comprising a screw threaded cap for the container having a rigid stem extending from the applicator cap portion terminating in what may be referred to as an applicator head, formed of a threaded rod, a helical brush, a small comb, or a plastic enlargement designed to have a coating of mascara on its surface to be directly applied to the eyelashes. The stem and applicator head portion of the applicator member is normally disposed in the mass of cosmetic or mascara within the container so that, when the applicator member is pulled from the container, excess mascara or cosmetic is removed by an elastic wiper as the applicator head is withdrawn. A metered amount of cosmetic remains between the convolutions, brush hairs or comb teeth of the applicator head for application to the eyelashes. While most mascara applicator and container assemblies are such that essentially the same metered quantity of mascara is retained on the applicator head for each withdrawal from the container and thus application of mascara to the upper or lower lashes will be essentially the same, it is frequently desirable to have a different quantity of mascara for the lower lashes relative to that applied to the upper lashes, and different users may desire to have different amounts of mascara retained on the applicator head.

Heretofore, efforts have been made to provide devices by which the customer or user may vary the amount of mascara retained on the applicator head upon withdrawal from the container, such as is disclosed in U.S. Pat. No. 3,998,235 granted Dec. 21, 1976, wherein the cap portion of the applicator member includes a rotatably adjustable portion forming a regulator dial member which will vary the spacing between successive convolutions of the applicator member and thereby vary the amount of mascara which can be retained by the applicator head portion.

An object of the present invention is the provision of a novel applicator and container assembly for a cosmetic product, such as mascara or other products, in liquid, semi-liquid, paste or powder form, wherein the container is provided with an adjustable collar portion and elastic wiper for varying the diameter or size of the wiper orifice and thereby varying the amount of product which can be retained on the applicator head portion as it is withdrawn from the container.

Another object of the present invention is the provision of a novel applicator and container assembly as defined in the immediately preceding paragraph, wherein the neck of the container is provided with a rotatably adjustable collet or ring and the applicator member is provided with a cap portion which is threaded onto the adjustable collet or ring, at the neck of the container to close the container, and wherein the adjustable collet or ring may be rotated to raise and lower a collet wiper member inside the neck of the container to increase and decrease the wiper orifice diameter by regulating the position of the collet wiper relative to a mechanical interface therefor formed at the container neck, to thereby accurately regulate and meter the quantity of product which coats the applicator head upon each withdrawal of the applicator member from the container.

Another object of the present invention is the provision of a novel applicator and container as described in the preceding paragraph, having detent means for indicating a plurality of angular collet or ring portions for preset wiper orifice diameters.

Other objects, advantages and capabilities of the present invention will become apparent from the following detailed description, taken in conjunction with the accompanying drawings illustrating preferred embodiments of the invention.

BRIEF DESCRIPTION OF THE FIGURES

FIG. 5 is a fragmentary vertical section view similar to FIG. 2, of another embodiment;

FIG. 6 is a transverse section view taken along the line 6—6 of FIG. 5, showing the adjustable ring with the stop in high position permitting maximum amount of mascara to remain on the applicator brush;

FIG. 7 is a section view taken at the same position as FIG. 5 but showing the ring positioned so that the stop is in its low position providing minimum retention of mascara on the brush by producing maximum wiping action during brush withdrawal;

FIG. 8 is an exploded fragmentary perspective view of portions of the applicator cap and adjustable ring and adjacent container portions making up the adjustable wiper mechanism of the present invention;

DETAILED DESCRIPTION OF A PREFERRED EMBODIMENT

Figure 1:
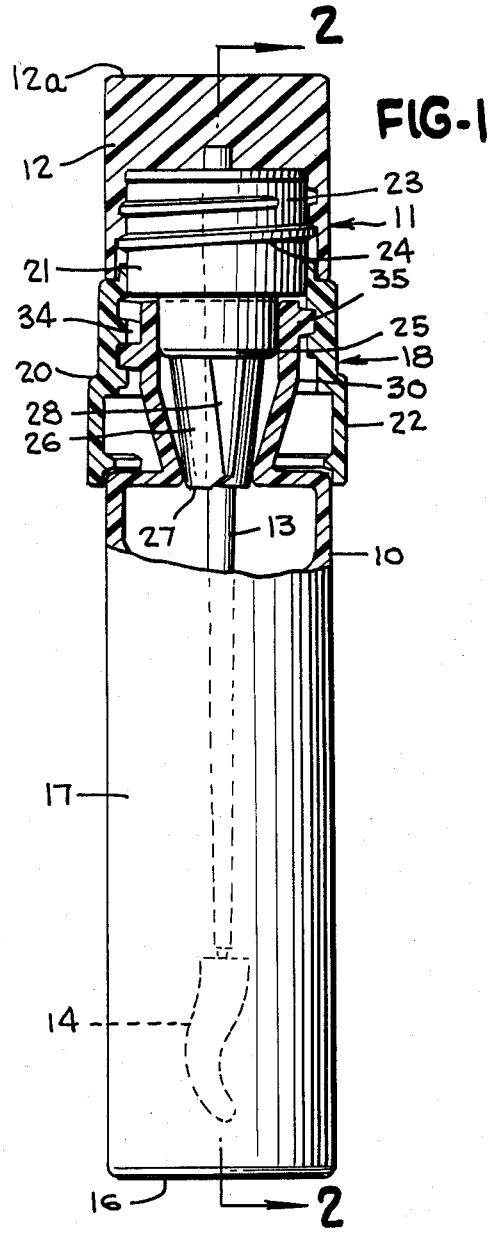
FIG. 1 is a longitudinal sectional view of an eyelash cosmetic applicator with an associated container shown partially broken away, constructed in accordance with the present invention.
Figure 2:
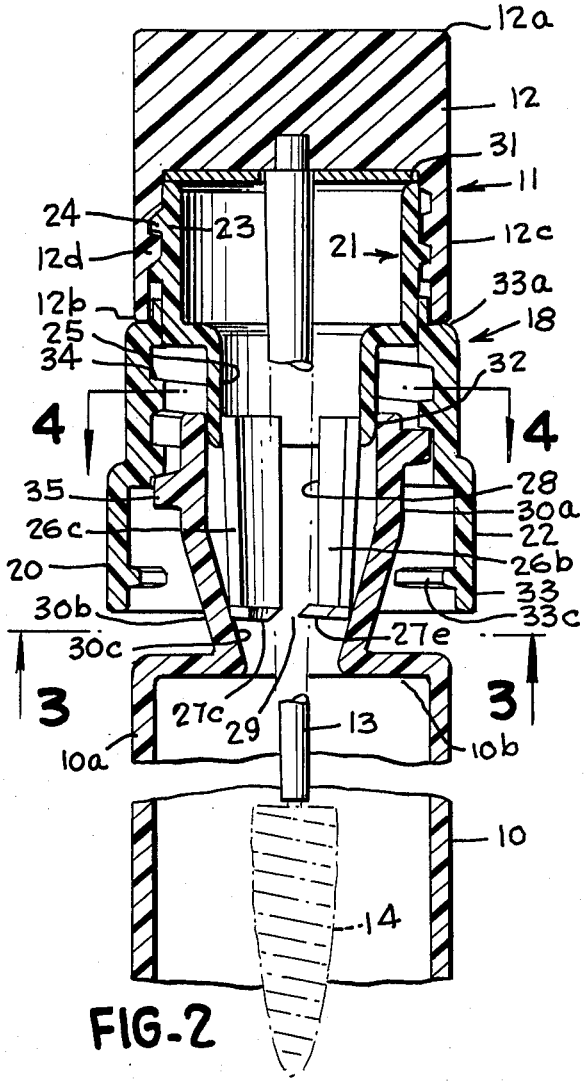
FIG. 2 is a fragmentary section view to enlarged scale, through the neck, outer ring and adjustable collet wiper portions, taken along the line 2—2 of FIG. 1.
Figure 4:
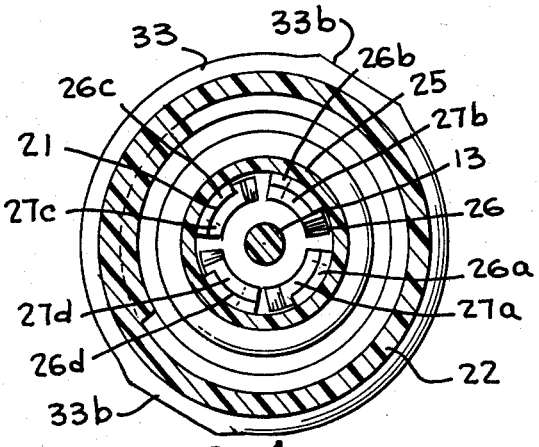
FIG. 4 is a horizontal section view taken along line 4—4 of FIG. 2.
Figure 3:
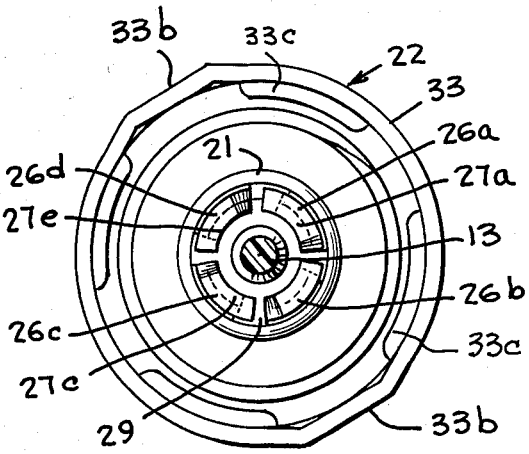
FIG. 3 is a transverse section view taken along the line 3—3 of FIG. 2, showing the adjustable collet wiper in bottom plan.

Referring to the drawings, wherein like reference characters designate corresponding parts throughout the several figures, there is illustrated in FIGS. 1 to 4 a first embodiment of a cosmetic applicator and container assembly particularly designed for use in applying coloring material such as mascara to eyelashes, comprising the basic package components of a container or bottle 10 for the mascara, on which is assembled an applicator 11 made up of a cap portion 12 serving as a closure cap for the container and also as a handle portion for the applicator, having a stem or wand portion 13 having one end rigidly fixed to the cap portion 12 and having at the other end a spiral wound brush portion 14 or any other type of applicator head which may be desired. For example, the applicator 11 and container 10 may be of the configuration illustrated in my copending U.S. patent application Ser. No. 855,067, filed Nov. 23, 1977, wherein the brush 14 is a spiral wound brush extending along a curvilinear path as illustrated and tapering from a larger diameter circular cross-section at the end of the brush nearest the cap portion 12 to a smaller diameter circular cross-section at the outermost end of the brush relatively most remote from the cap portion. The container or bottle 10 is preferably an elongated reservoir having a closed bottom end wall 16 joined integrally with the side wall portion 17 and having a constricted externally threaded neck assembly 18 surrounding the entrance opening or mouth 19 of the container. The container may be of generally rectangular cross-sectional configuration with rounded corners as illustrated in my earlier patent application identified above or may be a circular cross-section cylindrical container or any other desired configuration.

The cap portion 12 of the applicator 11 in the illustrated embodiment has a generally cylindrical exterior configuration, which may, if desired, be slightly tapered or flared from a smaller diameter at the closed end 12*a* thereof to a larger diameter at the open end 12*b* thereof, or may be of uniform diameter throughout as shown, and is provided with an internal cavity surrounded laterally by the flange or side portion 12*c* of the cap which has internal threads 12*d* along the interior inwardly facing surface of the flange or side portion 12*c* to mate with threads, hereinafter identified as male threads 24 on the ring member 22 at the neck end portion of the container or bottle 10. The container or bottle component 10 is provided with an assembled adjustable collet and ring assembly indicated generally at 20 coupled for rotation on the neck end portion of the container 10, which may be adjusted to different angular positions by the user to vary the amount of cosmetic product which remains on the brush or applicator head upon withdrawal from the container.

The collet and ring assembly 20 basically comprises an adjustable collet wiper orifice member 21 assembled with an outer ring member 22, either by separately forming the members 21 and 22 and securing them together by a suitable adhesive or bonding materials or by thermal sealing of the two elements together, or by forming the outer ring member 22 and collet member 21 as an integral single molded element. In either case, the adjustable collet wiper orifice member 21 includes an upper cylindrical threaded tubular neck formation 23 having exterior or male threads 24 thereon to mate with the interior or female threads 12*d* on the cap portion 12 to facilitate assembling the cap portion 12 onto the neck formation 23 for the container and withdrawal of the cap portion and applicator therefrom. Extending downwardly from the neck formation 23 of the adjustable collect member is a tubular cylindrical intermediate or middle portion 25 concentric with the same center axis as the neck formation 23.

A flexibly deformable collet segment formation, indicated generally at 26, extending from the lower end of portion 25 along a downwardly convergent generally frusto-conical path concentric with the extended center axis of the neck formation 23 and intermediate portion 25 and terminating at the lower or free ends of the collet segment formation 26 in inwardly extending wiper lips or flanges 27. The entire adjustable collet wiper orifice member 21 in the preferred embodiment is preferably a unitary molded plastic member of a plastic material which will impart flexible deformable characteristics to the collet segment formation 26, and the collet segment formation is formed of two or more collet segments, four of which indicated at 26*a*, 26*b*, 26*c* and 26*d* are provided in the illustrated embodiment. The tapered or convergent collet segment formation 26 is interrupted at spaced circumferential locations by slots 28 so that the individual collet segments 26*a*–26*d* are in the nature of elongated flexible fingers extending along downwardly convergent conical paths to the lower wiper lip or flange formations 27*a*–27*d*, which are similarly separated by circumferentially spaced slots 29 of narrower width than the slots 28. The ends of the flange segments 27*a*–27*d* at each of the slots 29 are alternately tapered from the top and the bottom as illustrated, to accommodate some overlapping of the flange segments as they converge. The segment formation 26 extends downwardly in telescoping relation into the constricted collar or throat formation 30 of the container 10, which has a generally cylindrical upper portion 30*a* outwardly surrounding and engaging the cylindrical intermediate portion 25 of the collet member 21 and upwardly and outwardly flaring lower throat portion 30*b* tapering in a frusto-conical path from the cylindrical portion 30*a* to the main portion 10*a* of the bottle. The throat formation 30 may be integral with the main portion of the container 10 or may be separately formed and then joined or secured to the container.

The cosmetic applicator and container package or assembly is sealed from outside environment when the cap is assembled on the threaded neck formation 23 of the orifice member 21 by use of a land seal at 31 between the cap 12 and the top edge of the collet neck 23 and a sliding seal in the zone 32 between the exterior surface of the cylindrical collet portion 25 and the confronting inwardly facing surface of the upper throat portion 30*a*.

Joined to and outwardly surrounding a portion of the adjustable collet wiper orifice member 21 is the outer ring member 22 having a cylindrical outer sleeve or cylindrical wall 33 provided with inwardly facing female threads 34 to be threadedly coupled with helical male threads 35 on the upper throat portion 30*a* of the container throat 30, together with an upper annular end wall 33*a* integral with the cylindrical ring portion 33 and extending inwardly to be secured to or join the collet member 21 adjacent the juncture between the neck formation 23 and intermediate portion 25.

Adjustment of the assembly to vary the amount of product retained on the brush or applicator head portion 14 of the applicator 11 is accomplished by rotating the ring member 22 to turn the collet and ring assembly 20 in a clockwise or counterclockwise direction, which raises or lowers the collet segments 26*a*–26*d* bearing against the sloping bottle throat inside surface 30*c*, which, in turn, through the mechanical interface between the outwardly facing surfaces of the collet segment 26*a–d* and the inwardly facing surface 30*c* opens or closes the wiper orifice diameter formed by the tapered edges 27*e* of the wiper lip or flange formations 27*a–d*. The collet segments 26*a–d* are designed to ride against the sloping inside throat portion 30*b* of the container or bottle 10 with the inside surface of the bottle throat forming a cam surface which allows the segments 26*a–d* to converge and reduce the orifice diameter between the edges of the lips or flanges 27*a–d* or allows the segments to move apart increasing the orifice diameter. The slots 28 and 29 between the respective segments and lip formations and the alternate tapering of the lip 27*a–d* from top and bottom at the wiping area permit the segments to converge or move apart without interfering with adjacent collet segment movement. In the illustrated embodiment, the sidewall 33 of the ring 22 includes a plurality of inwardly projecting flange segments or ribs 33*c* extending inwardly toward the center axis of the ring member a sufficient distance to overlap the upper annular wall portion 10*b* of the bottle or container 10 and extend inwardly to a circular path which is of very slightly smaller diameter than the maximum diameter of the helical male threads 35. These flange or rib formations 33*c* therefor form a stop to abut the annular shoulder 10*b* of the container in the lower portion of the ring 22, as illustrated in FIG. 1, and serve to form a snap-type limit stop when they abut the male threads 35 to restrain accidental unscrewing of the ring member 22 entirely off of the threads 35, although the wall 33 of the ring member is sufficiently deformable to permit the ribs 33*c* to snap over the male threads 35 during assembly.

Referring to FIGS. 5 through 8, there is illustrated a modification of the applicator and container assembly with an adjustable container neck assembly, having a slightly modified construction providing a detent mechanism for releasably restraining the outer ring member at a plurality of different angular positions corresponding to a plurality of selected preset wiper orifice diameters whereby the adjustable collet wiper orifice and ring assembly is detented at various positions indicating particular orifice diameters. The parts illustrated in FIGS. 5 to 8 which correspond to parts shown and described in connection with the first embodiment of FIGS. 1–4 are indicated by the same reference characters used in the previously described embodiment.

Referring to FIGS. 5–8, the inclined lower portion 30*b* of the throat 30 on the bottle or container 10 is additionally provided with a pair of generally planiform stop plate formations indicated at 40 and 41 protruding from the throat 30 and molded as part of an elliptical plane section on the inwardly and downwardly tapering lower throat portion 30*b* of the bottle throat below the zone of the thread 35. The planiform stop plate formation 40 has convex edges 40*a*, 40*b* which converge outwardly from the throat portion 30*b* to an apex or crest having an outwardly opening notch 42 therein, and the stop plate formation 41 has opposite edges 41*a* and 41*b* forming continuations of the convex edges 40*a* and 40*b* which merge with the outer surface of the throat portion 30*b* at their intersections with the throat, and define a convex outer edge 41*c* which is concentric with the center axis of the throat portion 30*b* and is curved to conform to the cylindrical path of the inner surface of the adjacent portions of ring 22. The stop plate member 41 has a pair of outwardly facing notches 43,44 therein. A cooperating detent bar or rib formation 45 projects inwardly from the inner surface of the wall 33 of the outer ring 22, as best shown in FIGS. 6 and 7, and is normally interfitted into one of the three notches 42,43 or 44 of the stop plate formations 40,41. An additional detent nose or projection 46 located above the level of the detent 45 is provided on the inner surface of the wall 33, and is positioned to abut with a fixed stop formation 47 projecting as a radial web or rib from the throat 30 as shown in FIGS. 5–8 when the ring assembly 20 is at the high position of FIG. 6 to prevent threading the ring assembly 20 all the way off of the collar.

It will be apparent that with the collet and ring assembly in the high position shown in FIGS. 5 and 6, wherein the collet segments 26*a–d* are in their uppermost position providing the widest orifice between the edges of the lips 27*a–d*, the operator desiring to adjust the collet and ring assembly to other preset positions can do so by rotating the ring 22 with sufficient force to overcome the detent resistance, or by squeezing the outer ring 22 by engagement of the flats 33*b* thereon, which in either case flexibly deforms the outer ring 22 to move the detent bar or rib formation 45 radially outwardly and withdraw it from the notch in one of the mating stop formations 40,41 in which it was seated, whereupon the operator may further rotate the outer ring to another preset position bringing the dentent bar or rib 45 into seated relation in another one of the notches 42,43 or 44. Counterclockwise or unscrewing rotation of the outer ring is limited in this embodiment by the detent nose 46 in the path of the fixed stop 47.

Either of the above described embodiments of the applicator and container assembly, by use of the segmented collet wiper which is manually adjustable by rotation of the associated outer ring 22, permits accurate control of the amount of liquid, semi-liquid, paste or powder composition deposited on the dispensing brush or other type of applicator head. The construction illustrated in FIGS. 5 to 8 provides the additional advantage of permitting the user to readily select a plurality of preset wiping diameters by adjusting the segmented collet wiper and outer ring to the various detented angular positions which, through the raising and lowering of the collet segments 26*a–d* and the interaction at the mechanical interface with the surface 30*c* of the container throat 30 increases and decreases the wiper orifice diameter to control the amount of liquid, semi-liquid, paste or powder deposited on the dispensing brush or applicator head.

Figure 9:
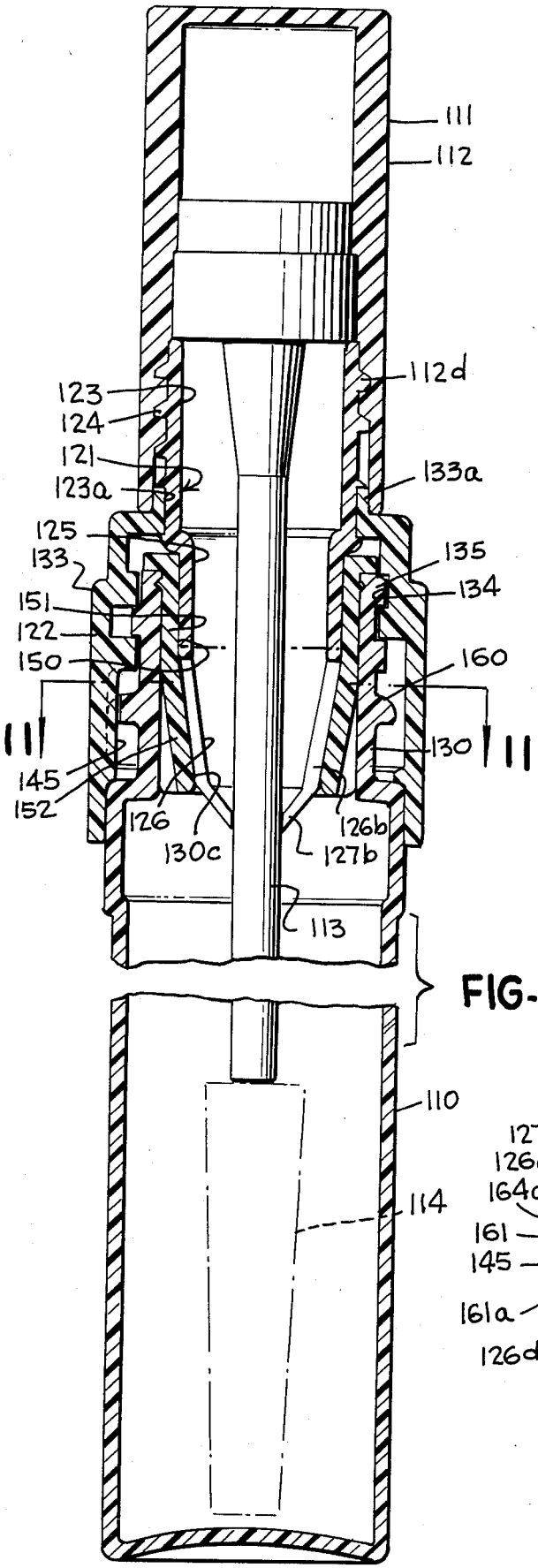
FIG. 9 is a fragmentary vertical section view through the upper portion of yet another embodiment, showing the adjustable ring and wiper in the lowermost or minimum orifice position.
Figure 10:
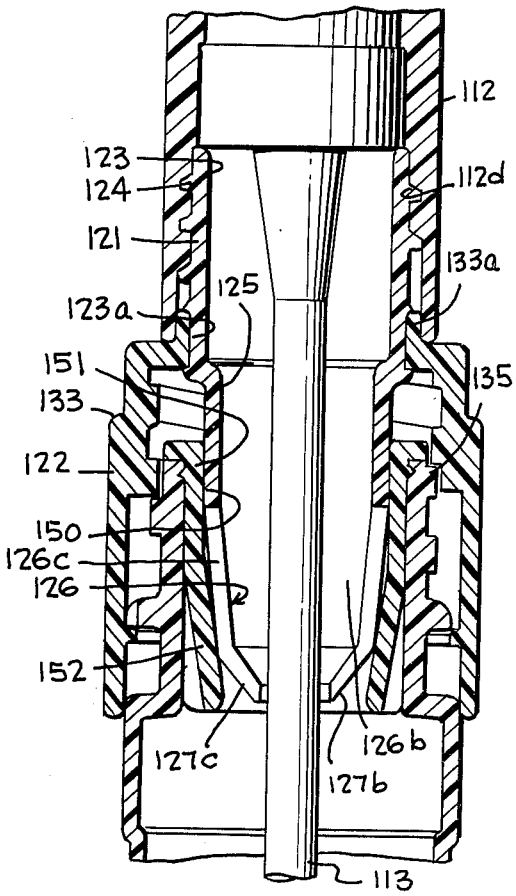
FIG. 10 is a fragmentary vertical section view similar to FIG. 9, but with the ring adjusted to the high position providing maximum orifice for the wiper.
Figure 11:
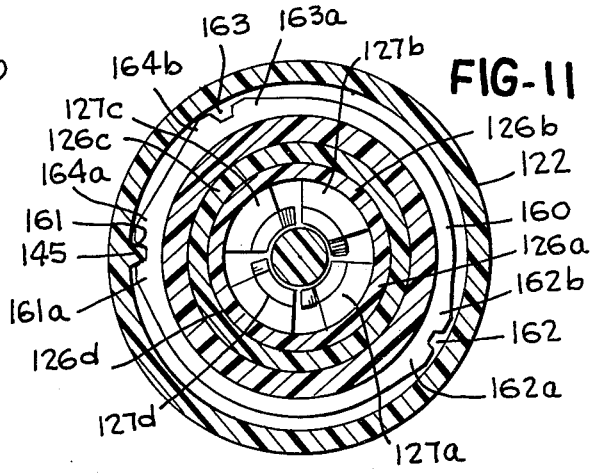
FIG. 11 is a horizontal section view taken along the line 11—11 immediately above the detent collar formation, with the adjustable ring in low position.

Referring now to FIGS. 9 through 11, there is illustrated another modification of the applicator and container assembly having an adjustable container neck arrangement, which provides a detent mechanism which is somewhat different from that of FIGS. 5 through 8, to releasably restrain the outer ring member at a plurality of different angular positions corresponding to a plurality of selected wiper orifice diameters. In the embodiment of FIGS. 9 through 11, parts which are similar to parts of the previously described embodiments are designated by reference characters in the 100 series corresponding otherwise to reference characters of the similar parts in the previously described embodiments.

Referring to FIGS. 9–11, the bottle or container 110 has a throat portion 130 of similar diameter than the maximum diameter of the container portion of the bottle 10, the throat portion 130 in this embodiment being substantially cylindrical and having the helical male thread formation 135 in the upper portion thereof to coact with female helical thread grooves 134 in the wall portion 133 of the outer ring member 122, whereby the outer ring member 122 moves axially upwardly or downwardly relative to the center axis of the bottle or container 110 upon clockwise or counterclockwise rotation of the ring member 122. The applicator 111 of the FIGS. 9–11 embodiment is similar to the previously described applicator, being made up of a cap portion 112 serving as a closure cap for the container and also as a handle portion for the applicator. The applicator also includes the stem or wand portion 113 having a brush 114 on the lower end thereof, which in this illustrated embodiment is a spiral brush which tapers slightly from a larger diameter to a smaller diameter toward the lower free end thereof and is concentric with the extended axis of the stem or wand 113.

The adjustable collet wiper orifice member 121 includes the upper cylindrical threaded tubular neck formation 123 having the exterior or male threads 124 thereon to mate with the interior or female threads **112*d* on the cap portion 112, and includes an outwardly facing annular groove 123*a* sized to snuggly receive and be secured or bonded in any suitable manner to the annular collar or lip 133*a* at the uppermost end of the outer ring member 122. Below the annular groove 123*a*, the adjustable collet member 121 has an intermediate substantially cylindrical portion 125 of slightly smaller diameter than the upper neck portion 123, and below the intermediate portion 125, the flexible deformable collet segment formation indicated at 126 extends downwardly and is formed, in the illustrated embodiment, of four collet segments 126*a*–126*d* separated circumferentially by slots 128 and having lower wiper lip or flange formations 127*a*–172*d* separated by circumferentially spaced slots 129 of narrower width than the slots 128, and being generally similar to the collet segments 26*a*–26*d*** of the previously described embodiments.

Outwardly surrounding the intermediate collet member portion 125 and the collet segment formation 126 is an insert member 150, which is joined, secured or bonded in any suitable manner to the throat portion 130 of the bottle or container 110 in nested relation within the throat portion 130. The insert member 150 has an upper cylindrical portion 151 and a lower downwardly and inwardly convergent portion 152 similar to the portions **30*a* and 30*b* of the throat of the first described embodiment, the walls of the downwardly and inwardly convergent frusto-conical lower portion 152 forming a cam surface 130*c*, similar to the cam surface 30*c* of the first described embodiment, bearing against the lower end portions of the collet segments 126*a*–126*d* to vary the size of the orifice defined between the lower wiper lip formations 127*a*–127*d* as a function of the vertical position of the collet segment portion 126 along the converging portion 152 of the insert 150. Forming the insert 150 as a separate member from the bottle throat portion 130 as separate elements and then fixing the insert 150 within the throat portion 130 facilitates manufacture of the article, and the converging lower portion 152 of the insert is sized to converge to a smaller inner diameter than the normal outer diameter of the lower portions of the collet segments 126*a*–126*d*. Thus, as the outer ring member 122 with the collet wiper orifice member 121 fixed thereto is rotated in a clockwise direction from the high position of FIG. 10 to the lowermost position of FIG. 9, the collet segments 126*a*–126*d* are progressively flexibly deformed inwardly from the maximum orifice position of FIG. 10 to the minimum orifice position of FIG. 9 by reason of the progressive downward movement of the ring member 122 and the collet wiper orifice member 121 axially downwardly relative to the center axis of the bottle 110 because of the interaction of the threads 134,135**.

Detenting of the collet wiper orifice and ring assembly in this embodiment is achieved by the detent ring formation 160 extending as a circular shaped collar protruding outwardly from the throat portion 130 in a plane generally perpendicular to the center axis of the bottle 110 and ring member 122 and having a specially shaped outer periphery. As illustrated in FIG. 11, the detenting ring formation includes a first outwardly facing notch 161 at the 9 o'clock position as viewed in FIG. 11, forming the detent notch for the lowermost wiper position, and intermediate notch 162 at approximately a 4 o'clock position as viewed in FIG. 1, and a high wiper position locating detent notch 163 at approximately the 11 o'clock position. These notches 161,162 and 163 are designed to coact with the inwardly projecting detent bar 145 projecting inwardly from the wall 133 of the ring member 122 to releasably interfit in the detent notches at the three previously mentioned locations. In the illustrated embodiment, the shape of the detenting ring formation 160 is such that its outer periphery is shaped to define outwardly inclined ramp formations **162*a*,162*b* at the opposite sides of the intermediate detent notch 162, and to provide similar inclined ramp enlargements 161*a* and 163*a* on the side nearest the intermediate notch 162 of the notches 161,163. The other sides of the lowermost and uppermost detenting notches 161,163 project further outwardly from the throat portion defining stop enlargements 164*a* and 164*b* to provide greater restraint against relative rotation of the detent bar 145 beyond the uppermost and lowermost limit positions defined by the detent notches 163,161**.

It will be appreciated that the outer ring member 122 and the collet wiper orifice member 121 are made of a flexibly deformable plastic material, in the preferred embodiment, permitting appropriate flexing of the collet segments **126*a*–126*d* inwardly from their normal position substantially as illustrated in FIG. 10 and their lowermost or minimum orifice position of FIG. 9 by the action of the cam surface portion 130*c* of the insert 150, and that the wall 133 of the outer ring member 122 is sufficiently flexibly deformable to permit the detent bar 145 to be forced out of the detent notches 161,162 and 163 in response to turning force applied to the ring member 122 by the hands of the user in appropriate directions to cause axial and rotary movement of the wiper member and segment portions thereof between the uppermost and lowermost positions for adjusting the size of the wiper orifice defined between the edges of the lip portions 127*a*–127*d* thereof. In one satisfactory embodiment wherein the stem 113 has a diameter of about 0.100 inch, the parts are dimensioned so that the orifice defined between the edges of the wiper lip 127*a*–127*d*** is about 0.150 inch for the high position, about 0.132 inch for the middle position, and about 0.112 inch for the low position.

I claim:

1. A cosmetic applicator and container assembly comprising a container for cosmetic material having an opening, an applicator having an elongated stem to extend through the opening and an elongated brush-like applicator head formation extending from and carried by an end of the stem adapted to be stored in the container and coated by the cosmetic material, an elastic deformable wiper mounted on the container at said opening having movable wiper edge portions defining a variable size wiper orifice through which the applicator head formation is to be withdrawn for use of the applicator in applying cosmetic material, and a manually adjustable orifice regulating member movable to various different positions on the container adjacent said opening and having means to vary the positions of said wiper edge portions for moving said wiper edge portions relative to each other to provide different wiper orifice sizes and thereby vary the wiping action of the wiper on the applicator head formation as it is withdrawn for use to control the amount of cosmetic material remaining on the head formation.

2. A cosmetic applicator and container assembly as defined in claim 1, wherein said wiper is an annular collet member having flexibly deformable segment portions extending inwardly of the opening and mounted for movement axially of the opening to vary the wiper orifice size.

3. A cosmetic applicator and container assembly as defined in claim 2, wherein said segment portions are in the form of elongated flexibly deformable fingers spaced circumferentially from each other concentrically about the axis of said opening and having inwardly projecting arcuate wiper lips extending toward said axis and collectively encircling the wiper orifice.

4. A cosmetic applicator and container assembly comprising a container for cosmetic material having an opening, an applicator having an elongated stem to extend through the opening and an elongated brush-like applicator head formation extending from and carried by an end of the stem adapted to be stored in the container and coated by the cosmetic material, an elastic deforamable wiper mounted on said opening of the container having flexibly deformable wiper segment portions defining a variable size wiper orifice through which the applicator head formation is to be withdrawn for use of the applicator in applying cosmetic material, cam surface means engaging said wiper segment portions for flexing them to positions providing various wiper orifice sizes, and a manually operable adjustable ring member surrounding said opening for moving said wiper segment portions relative to said cam surface means to vary the positions of said segment portions for providing different wiper orifice sizes and thereby varying the wiping action of the wiper on the applicator head formation as it is withdrawn for use to control the amount of cosmetic material remaining on the head formation.

5. A cosmetic applicator and container assembly as defined in claim 4, wherein said wiper is an annular collet member having said segment portions extending inwardly of the opening and mounted for movement axially of the opening to vary the wiper orifice size.

6. A cosmetic applicator and container assembly as defined in claim 5, wherein said segment portions are in the form of elongated flexibly deformable fingers spaced circumferentially from each other concentrically about the axis of said opening and having inwardly projecting arcuate wiper lips extending toward said axis and collectively encircling the wiper orifice.

7. A cosmetic applicator and container assembly as defined in claim 5, wherein said container includes an annular throat formation encircling the segment portions of said collet member having a truncated conical inner surface in encircling engagement with said segment portions shaped to form the cam surface means and progressively constrict the wiper orifice as the collet member is moved progressively inwardly within the container opening by said ring member.

8. A cosmetic applicator and container assembly as defined in claim 6, wherein said container includes an annular throat formation encircling the segment portions of said collet member having a truncated conical inner surface in encircling engagement with said segment portions shaped to form the cam surface means and progressively constrict the wiper orifice as the collet member is moved progressively inwardly within the container opening by said ring member.

9. A cosmetic applicator and container assembly as defined in claim 4, wherein said wiper is joined to said ring member for coordinate movement therewith and said ring member and container include coactive screw thread means producing predetermined axial movement of the ring member and wiper relative to the container upon rotation of the ring member about the container opening.

10. A cosmetic applicator and container assembly as defined in claim 6, wherein said wiper is joined to said ring member for coordinate movement therewith and said ring member and container include coactive screw thread means producing predetermined axial movement of the ring member and wiper relative to the container upon rotation of the ring member about the container opening.

11. A cosmetic applicator and container assembly as defined in claim 7, wherein said wiper is joined to said ring member for coordinate movement therewith and said ring member and container include coactive screw thread means producing predetermined axial movement of the ring member and wiper relative to the container upon rotation of the ring member about the container opening.

12. A cosmetic applicator and container assembly as defined in claim 8, wherein said wiper is joined to said ring member for coordinate movement therewith and said ring member and container include coactive screw thread means producing predetermined axial movement of the ring member and wiper relative to the container upon rotation of the ring member about the container opening.

13. A cosmetic applicator and container assembly as defined in claim 4, wherein said adjustable ring member is rotatable about the opening of said container through a predetermined angular range for moving the wiper axially between minimum and maximum orifice sizes, and the ring member and container having coactive releasable detent means for releasably restraining said ring member at a plurality of predetermined angular incremental postions within said range for indicating plural predetermined different orifice sizes.

14. A cosmetic applicator and container assembly as defined in claim 6, wherein said adjustable ring member is rotatable about the opening of said container through a predetermined angular range for moving the wiper axially between minimum and maximum orifice sizes, and the ring member and container having coactive releasable detent means for releasably restraining said ring member at a plurality of predetermined angular incremental postions within said range for indicating plural predetermined different orifice sizes.

15. A cosmetic applicator and container assembly as defined in claim 7, wherein said adjustable ring member is rotatable about the opening of said container through a predetermined angular range for moving the wiper axially between minimum and maximum orifice sizes, and the ring member and container having coactive releasable detent means for releasably restraining said ring member at a plurality of predetermined angular incremental positions within said range for indicating plural predetermined different orifice sizes.

16. A cosmetic applicator and container assembly as defined in claim 8, wherein said adjustable ring member is rotatable about the opening of said container through a predetermined angular range for moving the wiper axially between minimum and maximum orifice sizes, and the ring member and container having coactive releasable detent means for releasably restraining said ring member at a plurality of predetermined angular incremental positions within said range for indicating plural predetermined different orifice sizes.

17. A cosmetic applicator and container assembly as defined in claim 9, wherein said adjustable ring member is rotatable about the opening of said container through a predetermined angular range for moving the wiper axially between minimum and maximum orifice sizes, and the ring member and container having coactive releasable detent means for releasably restraining said ring member at a plurality of predetermined angular incremental positions within said range for indicating plural predetermined different orifice sizes.

18. A cosmetic applicator and container assembly as defined in claim 11, wherein said adjustable ring member is rotatable about the opening of said container through a predetermined angular range for moving the wiper axially between minimum and maximum orifice sizes, and the ring member and container having coactive releasable detent means for releasably restraining said ring member at a plurality of predetermined angular incremental positions within said range for indicating plural predetermined different orifice sizes.

19. A container applicator and container assembly as defined in claim 13, wherein said detent means comprises a plurality of angularly spaced outwardly facing detent notch formations on said container and an inwardly extending detent projection on said ring member disposed to interfit in said notch formations, and said ring member having a flexibly deformable annular wall carrying said detent projection and being manually distortable to withdraw the detent projection from its detent notch for angular adjustment of the ring member to another detent position.

20. A container applicator and container assembly as defined in claim 15, wherein said detent means comprises a plurality of angularly spaced outwardly facing detent notch formations on said container and an inwardly extending detent projection on said ring member disposed to interfit in said notch formations, and said ring member having a flexibly deformable annular wall carrying said detent projection and being manually distortable to withdraw the detent projection from its detent notch for angular adjustment of the ring member to another detent position.

21. A container applicator and container assembly as defined in claim 17, wherein said detent means comprises a plurality of angularly spaced outwardly facing detent notch formations on said container and an inwardly extending detent projection on said ring member disposed to interfit in said notch formations, and said ring member having a flexibly deformable annular wall carrying said detent projection and being manually distortable to withdraw the detent projection from its detent notch for angular adjustment of the ring member to another detent position.

* * * * *